United States Patent [19]

Galvin et al.

[11] Patent Number: 4,679,881

[45] Date of Patent: Jul. 14, 1987

[54] ELECTRICAL INTERCONNECTION APPARATUS AND TECHNIQUE

[75] Inventors: Aaron A. Galvin, Lexington; Hugh D. Dyer, Norton; Kenneth J. Leff, Halifax, all of Mass.

[73] Assignee: American District Telegraph Company, New York, N.Y.

[21] Appl. No.: 731,672

[22] Filed: May 7, 1985

[51] Int. Cl.[4] ..... H01R 4/24

[52] U.S. Cl. ..... 439/392

[58] Field of Search ..... 339/97 R, 97 P, 98, 339/99 R

[56] References Cited

U.S. PATENT DOCUMENTS

| | | | |
|---|---|---|---|
| 2,802,083 | 8/1957 | Lapeyre | 339/97 R |
| 3,617,983 | 11/1971 | Patton | 339/98 |
| 3,761,771 | 9/1973 | Thompson et al. | 339/97 R |
| 3,835,444 | 9/1974 | Plana et al. | 339/98 |
| 4,444,447 | 4/1984 | Markwardt | 339/98 |
| 4,533,191 | 8/1985 | Blackwood | 339/97 R |

*Primary Examiner*—Joseph H. McGlynn

*Attorney, Agent, or Firm*—Weingarten, Schurgin, Gagnebin & Hayes

[57] ABSTRACT

Apparatus and technique for providing series electrical connection between a conductor and an electrical component or unit in a rapid and automatic manner without the necessity for manual manipulation or preparation of the conductor. A pair of spaced walls are provided each containing a pair of wire-guiding slots through which a wire can be looped, with the loop end extending outside one of the walls. A pair of insulation displacement connectors is provided between the walls with wire receiving grooves in alignment with the slots in the spaced walls. A knife edge is provided between one of the walls and the connectors. A cover or other element is fitted over the walls and, during closure, causes the wire to be forced into the connector grooves to make electrical connection with the respective connectors, and also causes severing of the loop end of the wire by the knife edge, thereby to provide a series electrical connection. The spaced walls can be the walls of a housing which includes an electrical unit to be connected, or can be provided in a connection apparatus which is part of the utilization circuit, unit or other means.

8 Claims, 6 Drawing Figures

ELECTRICAL INTERCONNECTION APPARATUS AND TECHNIQUE

FIELD OF THE INVENTION

This invention relates to the field of electrical interconnections and more particularly to apparatus and technique for providing a series electrical connection between a conductor and an electrical component or unit.

BACKGROUND OF THE INVENTION

It is often required to electrically interconnect in series a plurality of components or units of a system. For example, in electronic alarm systems, sensor switches and sensor units are often interconnected electrically in series to provide a single loop configuration. The electrical conductor interconnecting the plurality of components or units must be cut, and the insulation stripped, to make electrical connection to each respective device. The connections between the respective devices and conductor are usually accomplished manually, requiring labor and time to prepare each electrical termination and provide the connection between the prepared wire ends and the electrical terminals of the associated device or unit.

Electrical connection techniques are known in which the insulation need not be removed from the end of an insulated conductor in order to make electrical connection to an associated contact. In this type of connector, the contact has a knife edge or barb which pierces or slices through the electrical insulation to make contact with the conductor of the insulated wire. One type of connector is called an insulation displacement connector (IDC) in which a pair of spaced knife edges is provided into which an insulated wire is forced, the knife edges slicing through the insulation to contact the conductor. Terminations are also known for use in lamp cord switches in which one conductor of the two-conductor cord to be connected to the switch is cut and inserted into a receptacle provided in the switch housing, and which include barbs which pierce the insulation to contact the conductor. In these known connection schemes, the wire must still be manually cut and often cut to a critical length in order to properly mate or seat with the associated connector housing.

It would be useful to provide a technique and apparatus for automatically making series connections between an electrical conductor and associated components or units.

SUMMARY OF THE INVENTION

Briefly, the present invention provides apparatus and a technique for providing series electrical connection between a conductor and an electrical component or unit in a rapid and automatic manner without the necessity for manual manipulation or preparation of the conductor. In practice of the invention, a user simply places an insulated conductor in the housing of a component or unit to be connected and closes a cover portion of the housing, which causes cutting of the conductor and engagement of the two conductor ends to respective contacts in the housing to complete the series connection.

In one preferred embodiment, the housing includes a pair of insulation displacement (IDC) connectors and a knife blade which confronts an opening in the housing. An insulated wire is formed into a U-shaped loop, and this loop is placed across the housing opening in or in alignment with the IDC connectors and with the end portion of the loop overlying the knife blade. Upon closure of a cover, the end portion of the wire loop is forced into cutting engagement with the knife blade, causing this loop portion to be severed from the wire. At the same time, the now severed ends of the conductor are forced into the IDC connectors to cause engagement of the conductor ends with the contacts of the connectors to complete the series interconnection. The housing typically includes guides to appropriately orient the wire prior to closure of the cover. Series connections can thereby be rapidly made without necessity for any cutting or stripping tools and with little expertise needed to perform the electrical connections. The invention is especially useful in systems in which a large number of series connections are to be made, as in an alarm installation in which door and window switches, motion sensors and other sensing units are to be connected to a wire for coupling back to a central control unit. The invention also allows the series connections to be made by relatively unskilled personnel, since the connections are automatically provided by virtue of the invention.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
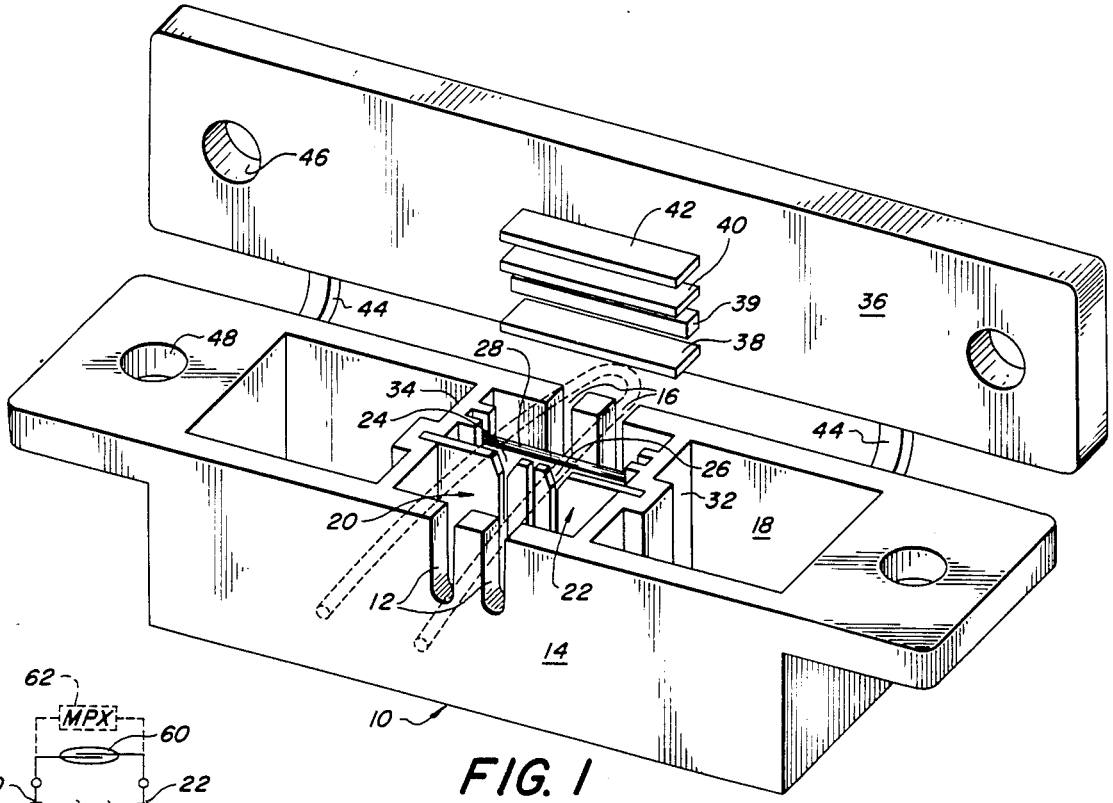
FIG. 1 is a pictorial view of an electrical housing including apparatus in accordance with the invention.
Figure 2:
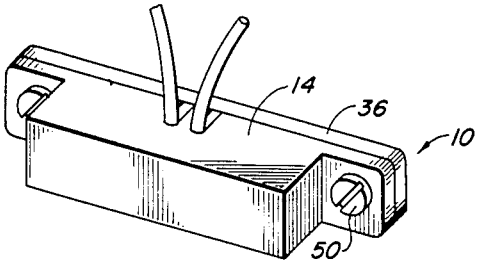
FIG. 2 is a pictorial view of the housing of FIG. 1 in closed condition and illustrating a conductor connected thereto.
Figure 3:
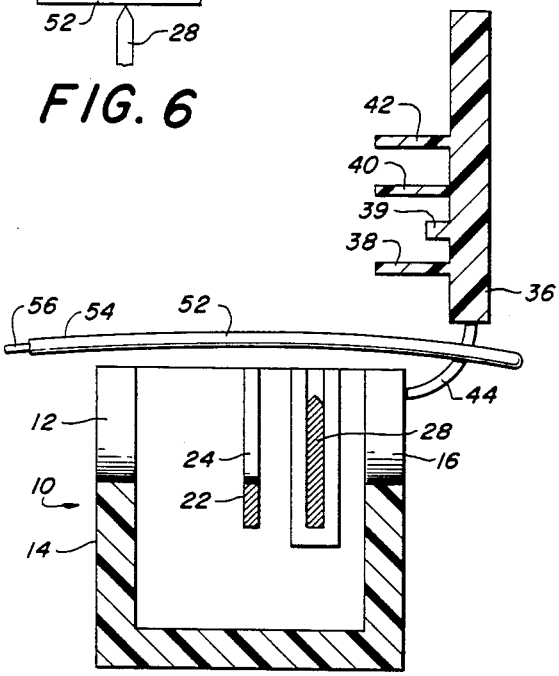
FIG. 3 is a side elevation view of the embodiment of FIG. 1 illustrating the cover in open position and with a conductor oriented for installation into the housing.

Referring to FIGS. 1 and 2, there is shown a plastic molded electrical housing of a type which typically is employed for containing a proximity switch such as used for sensing the open and closed conditions of a door or window. The housing 10 includes a first pair of slots 12 in the wall 14 thereof, and a pair of slots 16 in an opposite wall 18 and in alignment with the respective slots 12. First and second insulation displacement (IDC) connectors 20 and 22 are provided within the housing and include respective grooves 24 and 26 in alignment with the respective housing openings 12 and 16. A knife blade 28 is provided within the housing in spaced relation to the IDC connectors 20 and 22 and having a knife edge 30. The IDC connectors and knife blade are retained in the illustrated embodiment in respective channels provided in cross members 32 and 34.

Figure 6:
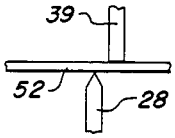
FIG. 6 is a partial elevation view of an alternative implementation.

A cover 36 for the housing 10 includes outwardly extending flanges 38, 40 and 42. The flanges 40 and 42 are spaced to be disposed on respective sides of the IDC connectors 20 and 22, while the flange 38 is spaced to be disposed on the opposite side of the knife blade 28 from flange 40. The flange 39 is configured to abut the knife edge 30 when the cover is closed, and serves as an anvil to assist in severing the wire. Preferably, the cover 36 is attached to the housing 10 by straps 44 which can be integrally formed with the cover and housing or by other living hinge integral with the housing. The cover includes an opening 46 at each end thereof in alignment with an opening 48 at each end of housing 10 for accommodation of mounting screws 50 (FIG. 2) which serve to secure the housing to a mounting surface and which also serve to retain the cover on the housing. The flanges can be integrally molded with the cover. The flange 39 can be of metal to better serve as an anvil, and can be secured to the cover by any convenient means such as in a slot provided in the cover. Alternatively, the flange 39 can be offset from the knife blade 28 to shear the wire during cover closure, as in FIG. 6.

Figure 5:
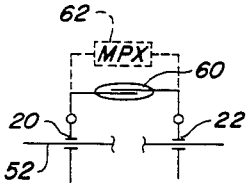
FIG. 5 is a schematic diagrm illustrating the electrical connection of the invention.
Figure 4:
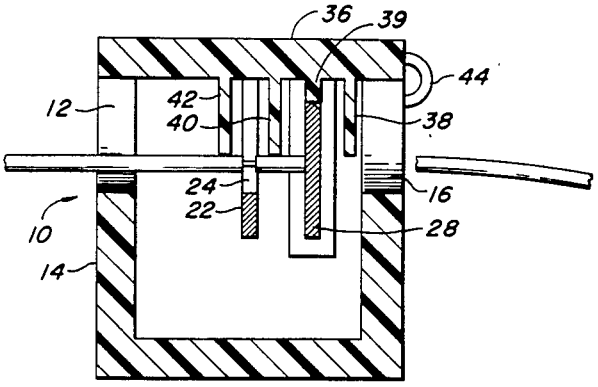
FIG. 4 is a side elevation view of the housing of FIG. 1 with the cover in closed position and with the conductor installed therein.

In operation, a conductor 52 is looped in a generally U-shape at the entrance end of the slots 12 and 16 and entrance end of the IDC slots 24 and 26. The conductor can be of any convenient form having a layer 54 of insulation over a solid or stranded conductor 56. The cover 36 is placed in alignment over the housing 10 and is pressed into engagement, as shown in FIG. 4, to cause the conductor 52 to be forced into the IDC slots 24 and 26 to cause engagement of the conductor 56 by the respective contact edges of the IDC connectors. During closure of the cover, the knife blade is forced through the loop ends of the wire 52 to sever both wires of the loop end. Each connected end of the wire 52 is now in electrical engagement with a respective connector by which the respective wires are connected to an electrical component, device or circuit. A series electrical connection is thereby easily made without any use of tools and without any requirement for skilled or dextrous handling. The completed electrical interconnection is shown in FIG. 5. The wire 52 is electrically connected to IDC connectors 20 and 22, each of which is electrically connected to a respective terminal of a reed relay 60, multiplexer 62 or other device or circuit.

The embodiment described above employs the invention in a relatively small housing. The invention can also be embodied in a larger housing which includes the connector portion and electrical circuits or devices being connected to the series line. It is also contemplated that the invention need not be employed in a housing as such. The alignment grooves can be within spaced walls of a connection block which can be incorporated in apparatus being connected. It will also be appreciated that a variety of means can be provided to suit a specific housing configuration by which the wire is forced into the IDC connector or other appropriate connector, and by which the loop end is severed by the knife edge. It is also contemplated that a single wire cut can be sufficient in some embodiments. In such single cut versions, means should be provided to maintain the severed ends out of electrical contact with each other or with surrounding conductive elements. Accordingly, the invention is not to be limited by what has been particularly shown and described except as indicated in the appended claims.

What is claimed is:

1. For use in providing a series electrical connection between a conductor and an electrical unit, apparatus comprising:

means having a pair of spaced walls, each of the walls including first and second slots in alignment with corresponding first and second slots of the other wall;

a first insulation displacement (IDC) connector having a groove aligned with and positioned between said first slot and said corresponding first slot;

a second insulation displacement (IDC) connector electrically separate from the first connector and having a groove aligned with and positioned between said second slot and said corresponding second slot;

said grooves of said first and second connectors each adapted to engage a conductor such that said conductor and said connector are an electrical communication;

a knife blade spaced between the insulation displacement connectors and one of the housing walls and having an upper knife edge confronting the corresponding first and second slots;

the slots of the walls and connector grooves defining a path along which said conductor can be looped, with the loop end of the conductor extending outside one wall adjacent to the knife blade;

means for coupling each of said connectors to a respective terminal of an electrical unit;

cover means operative to be secured over the walls and including means operative to force said conductor disposed in the slots of the walls into the grooves of the IDC connectors and also operative to force the conductor against the knife blade to sever the loop end of the conductor at positions adjacent the corresponding first and second slots.

2. Apparatus for making a series electrical connection between a conductor and an electrical unit comprising:

a housing having a pair of spaced walls each including first and second slots in alignment with corresponding first and second slots of the other wall;

first connector means disposed between the walls and in alignment with said first slot and said corresponding first slot;

second connector means electrically separate from the first connector means and disposed between the walls and in alignment with said second slot and said corresponding second slot;

said first and second connector means each adapted to engage a conductor such that said conductor and said connector means are in electrical communication;

means for coupling each of said connector means to a respective terminal of an electrical unit;

a knife blade spaced between the connector means and one of the housing walls and having an upper knife edge confronting the corresponding first and second slots;

the slots in the walls defining a path along which a conductor can be looped, with the loop end of the conductor extending outside one wall adjacent to the knife blade;

cover means operative to be secured over the walls and including means operative to force the conductor disposed in the slots into the connector means and also operative to force the conductor against the knife blade to sever the loop end of the conductor at positions adjacent the corresponding first and second slots.

3. The apparatus of claim 2 wherein the cover means is integral with the housing.

4. The apparatus of claim 2 wherein the cover means includes first and second flanges outwardly extending from the inner surface of the cover means and disposed on respective sides of the connector means and operative to urge the conductor in the aligned slots into engagement with the connector means;

a flange outwardly extending from the inner surface of the cover means and in alignment with the knife edge and operative to urge the conductor in the aligned slots into cutting engagement with the knife edge.

5. The apparatus of claim 2 wherein the connector means are each IDC connectors.

6. The apparatus of claim 2 wherein the cover means is integral with the housing and the housing includes means for mounting the housing to a support surface.

7. The apparatus of claim 2 wherein the cover means includes a plurality of flanges outwardly extending from the inner surface of the cover means and operative to urge a conductor disposed in the aligned slots into the connector means and into the knife edge.

8. The apparatus of claim 7 wherein said flanges are aligned transverse to said path.

* * * * *